US012492618B2

(12) United States Patent
Brown

(10) Patent No.: US 12,492,618 B2
(45) Date of Patent: Dec. 9, 2025

(54) DELAYED OPENING SIDE POCKET MANDREL

(71) Applicant: Baker Hughes Oilfield Operations LLC, Houston, TX (US)

(72) Inventor: Donavan Brown, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 50 days.

(21) Appl. No.: 18/377,225

(22) Filed: Oct. 5, 2023

(65) Prior Publication Data

US 2025/0116175 A1 Apr. 10, 2025

(51) Int. Cl.
*E21B 43/12* (2006.01)

(52) U.S. Cl.
CPC ..... *E21B 43/123* (2013.01)

(58) Field of Classification Search
CPC ..... E21B 43/123
See application file for complete search history.

(56) References Cited

U.S. PATENT DOCUMENTS

| | | | |
|---|---|---|---|
| 2,649,272 | A | 8/1953 | Barbato |
| 2,845,940 | A | 8/1958 | Garrett et al. |
| 2,942,671 | A | 6/1960 | Josephine |
| 3,160,113 | A | 12/1964 | Meyers |
| 3,646,953 | A | 3/1972 | Elliott et al. |
| 3,654,949 | A | 4/1972 | Mcmurry |
| 3,863,961 | A | 2/1975 | Dinning |
| 3,874,445 | A | 4/1975 | Terral |
| 3,888,273 | A | 6/1975 | Douglas |
| 4,033,409 | A | 7/1977 | Hebert |
| 4,035,103 | A | 7/1977 | McMurry et al. |
| 4,135,576 | A | 1/1979 | Tausch |
| 4,146,091 | A | 3/1979 | Terral |
| 4,265,306 | A | 5/1981 | Stout |

(Continued)

FOREIGN PATENT DOCUMENTS

| | | | |
|---|---|---|---|
| EP | 2666957 | A2 | 11/2013 |
| WO | 2004031529 | A2 | 4/2004 |

(Continued)

OTHER PUBLICATIONS

"MMRG Series Side Pocket Mandrels", Schlumberger, MMRG Series Side Pocket Mandrels, Sales Brochure, 2015.

(Continued)

*Primary Examiner* — Kelsey E Cary
(74) *Attorney, Agent, or Firm* — Baker Hughes Patent Organization

(57) ABSTRACT

A side pocket mandrel for use in a gas lift system is configured to improve the recovery of petroleum fluids from a well, where the gas lift system is surrounded by an annular space within the well. The side pocket mandrel includes a central bore extending through the side pocket mandrel, a side pocket tube laterally offset from the central bore, a port that extends from the side pocket tube to the annular space, and a single actuation valve installed on the port. The single actuation valve prevents the passage of the petroleum fluids from the annular space into the side pocket tube until a high threshold pressure in the annular space is reached and then the pressure in the annular space is reduced so to a low threshold pressure.

20 Claims, 10 Drawing Sheets

(56) References Cited

U.S. PATENT DOCUMENTS

| | | | | |
|---|---|---|---|---|
| 4,295,795 | A | 10/1981 | Gass et al. | |
| 4,295,796 | A | 10/1981 | Moore | |
| 4,333,527 | A | 6/1982 | Higgins et al. | |
| 4,437,487 | A | 3/1984 | Marmon | |
| 4,505,331 | A | 3/1985 | Akkerman | |
| RE32,441 | E | 6/1987 | Higgins et al. | |
| 4,685,523 | A | 8/1987 | Paschal et al. | |
| 4,722,393 | A | 2/1988 | Rumbaugh | |
| 4,759,410 | A | 7/1988 | Benker et al. | |
| 5,069,242 | A * | 12/1991 | Kilgore | E21B 43/123 137/155 |
| 5,176,164 | A | 1/1993 | Boyle | |
| 5,535,767 | A | 7/1996 | Schnatzmeyer et al. | |
| 5,971,004 | A | 10/1999 | Pringle | |
| 6,070,608 | A | 6/2000 | Pringle | |
| 6,082,455 | A | 7/2000 | Pringle et al. | |
| 6,148,843 | A | 11/2000 | Pringle | |
| 6,206,645 | B1 | 3/2001 | Pringle | |
| 6,241,015 | B1 | 6/2001 | Pringle et al. | |
| 6,375,155 | B1 | 4/2002 | Janssens | |
| 6,679,332 | B2 | 1/2004 | Vinegar et al. | |
| 6,715,550 | B2 | 4/2004 | Vinegar et al. | |
| 6,722,632 | B2 | 4/2004 | Kenny et al. | |
| 7,213,607 | B2 | 5/2007 | De | |
| 7,228,909 | B2 | 6/2007 | Schmidt et al. | |
| 7,658,229 | B2 | 2/2010 | Becker et al. | |
| 8,162,060 | B2 | 4/2012 | Randazzo | |
| 8,453,736 | B2 | 6/2013 | Constantine | |
| 8,714,264 | B2 | 5/2014 | Fay | |
| 8,881,825 | B2 | 11/2014 | White et al. | |
| 9,057,243 | B2 | 6/2015 | Hendel et al. | |
| 9,453,397 | B2 | 9/2016 | Dowling et al. | |
| 9,453,398 | B1 | 9/2016 | Zhang et al. | |
| 9,587,463 | B2 | 3/2017 | Tveiten et al. | |
| 10,655,439 | B2 | 5/2020 | Murdoch et al. | |
| 10,677,028 | B2 | 6/2020 | Oliphant | |
| 10,787,889 | B2 | 9/2020 | Salihbegovic et al. | |
| 10,830,012 | B2 | 11/2020 | Holmes et al. | |
| 11,578,569 | B2 | 2/2023 | Rodger | |
| 11,851,988 | B2 | 12/2023 | Newton et al. | |
| 2001/0017157 | A1 | 8/2001 | Pringle | |
| 2002/0020533 | A1 | 2/2002 | Tubel | |
| 2002/0029883 | A1 | 3/2002 | Vinegar et al. | |
| 2003/0164240 | A1 | 9/2003 | Vinegar et al. | |
| 2006/0137881 | A1 | 6/2006 | Schmidt et al. | |
| 2007/0181312 | A1 | 8/2007 | Kritzler et al. | |
| 2007/0227739 | A1 | 10/2007 | Becker et al. | |
| 2008/0135255 | A1 | 6/2008 | Coronado et al. | |
| 2011/0083855 | A1 | 4/2011 | Wygnanski | |
| 2012/0292034 | A1 | 11/2012 | Fay | |
| 2013/0146155 | A1 | 6/2013 | Gilbertson et al. | |
| 2013/0220599 | A1 | 8/2013 | Rae | |
| 2013/0312833 | A1 * | 11/2013 | Salihbegovic | E21B 43/123 137/155 |
| 2014/0352982 | A1 | 12/2014 | White et al. | |
| 2016/0290099 | A1 | 10/2016 | Balasubramanian | |
| 2017/0089175 | A1 | 3/2017 | Doane et al. | |
| 2020/0011155 | A1 | 1/2020 | Stamm et al. | |
| 2020/0032592 | A1 | 1/2020 | Romer et al. | |
| 2020/0256144 | A1 | 8/2020 | Deville et al. | |
| 2021/0131238 | A1 | 5/2021 | Stojkovic et al. | |
| 2022/0162928 | A1 | 5/2022 | Harestad | |
| 2022/0220834 | A1 | 7/2022 | Brown et al. | |
| 2023/0116200 | A1 | 4/2023 | Guest | |
| 2023/0272685 | A1 | 8/2023 | Dave et al. | |
| 2024/0052730 | A1 | 2/2024 | Balasubramanian et al. | |

FOREIGN PATENT DOCUMENTS

| | | | |
|---|---|---|---|
| WO | 2014022121 | A1 | 2/2014 |
| WO | 2016049726 | A1 | 4/2016 |
| WO | 2020212726 | A1 | 10/2020 |
| WO | 2022173815 | A1 | 8/2022 |

OTHER PUBLICATIONS

Abdalsadig, Mohamed , et al., "Gas Lift Optimization Using Smart Gas Lift Valve", Abdalsadig et al., Gas Lift Optimization Using Smart Gas Lift Valve; World Academy of Science, Engineering and Technology International Journal of Mechanical and Mechatronics Engineering, vol. 10, No. 6, 2016.

Schlumberger , "Side Pocket Mandrels—Reliable Gas Lift with Flexibility for the Future; 17-AL-291763", Jan. 1, 2017.

Schlumberger , "SO2-30R-B Dual-Check Shear Orifice Gas Lift Valve", Schlumberger; SO2-30R-B Dual-Check Shear Orifice Gas Lift Valve; 2011, Jan. 1, 2011.

Schlumberger , "WRFC-H Wireline-retrievable flow control valve for gas lift applications", Schlumberger; WRFC-H Product Brochure; 09-CO-0263; 2010, Jan. 1, 2010.

Zhiyue, Xu , et al., "Smart Gas Lift Valves Eliminate Multiple Slickline Trips in Gas Lift Operations", Zhiyue, et al., Smart Gas Lift Valves Eliminate Multiple Slickline Trips in Gas Lift Operations, Offshore Technology Conference Asia, 2014.

Botil; Gas Lift Equipment Catalogue; www.botilindia.com; date unknown.

"Side Pocket Mandrels", Parveen Industries Pvt. Ltd., Side Pocket Mandrels; www.parveen.in/products/side-pocket-mandrels; webpage captured Jul. 29, 2022.

Schnatzmeyer, M.A. , et al., "Development of a Surface-Controlled Electric Gas-Lift Valve", Journal of Petroleum Technology, May 1, 1994, May 1, 1994.

ISA/KR; Int'l Search Report and Written Opinion; Dec. 24, 2024; PCT/US2024/048765.

* cited by examiner

DELAYED OPENING SIDE POCKET MANDREL

FIELD OF THE INVENTION

This invention relates generally to the field of oil and gas production, and more particularly to a gas lift system that incorporates an improved side pocket mandrel with delayed opening functionality.

BACKGROUND

Gas lift is a technique in which gaseous fluids are injected into the tubing string to reduce the density of the produced fluids to allow the formation pressure to push the less dense mixture to the surface. In annulus-to-tubing systems, pressurized gases are injected from the surface into the annulus, where the pressurized gases enter the tubing string through ports in the side pocket mandrel that communicate the injected gases through a gas lift valve inside the side pocket mandrel. Alternatively, in tubing-to-annulus systems, pressurized gases are injected into the tubing string and discharged into the annulus through the gas lift valve and ports, where the gases help to produce fluids out of the annulus. Thus, the gas lift valves allow access from the annulus into the production tubing or from the production tubing into the annulus. The gas lift valves can be configured to automatically open when the pressure gradient between the annulus and the production tubing exceeds the closing force holding each gas lift valve in a closed position.

To permit the unimpeded production of wellbore fluids through the production tubing, the gas lift valves are housed within "side pocket mandrels" that include a valve pocket (or side pocket tube) that is laterally offset from the primary longitudinal axis extending through the production tubing. Ports extend through the valve pocket and side pocket mandrel to provide a fluid path between the annulus and the interior of the valve pocket. Because the gas lift valves are contained in these laterally offset valve pockets, tools can be deployed and retrieved through the open primary passage (central bore) of the side pocket mandrel. The predetermined position of the gas lift valves within the production tubing string controls the entry points for gas into the production string. For illustration purposes, FIG. 1A depicts a PRIOR ART side pocket mandrel 200 in which gases injected into the annulus surrounding the side pocket mandrel 200 are admitted into the side pocket mandrel 200 through a gas lift valve 202 installed within the side pocket mandrel 200. The gas lift valve 202 is configured to open in response to a sufficient pressure gradient between the annulus and the interior of the side pocket mandrel 200.

When a well is first opened, the reservoir may have sufficient internal driving energy to produce a commercially adequate flow of the formation fluid to the surface. In time, however, that internal energy source may be dissipated long before the reservoir value is depleted. Production experience may anticipate such production developments by positioning side pocket mandrels in the production tube long before the actual need for gas lifted production. When the need for gas lifting arises, the only downhole operations required to begin gas lifting are the wireline placement of the gas lift valve elements in the respective side pockets. Compared to the enterprise of withdrawing and returning several miles of production tubing or coil tubing in a well, wireline procedures are minimal.

If the well operator needs to conduct an annular pressure test, the absence of a gas lift valve in the side pocket mandrel would allow pressurized gases to pass through the side pocket mandrel, thereby compromising the annular pressure test. Even if gas lift valves are present in the side pocket mandrel, the pressure used for the annular pressure test can exceed the opening pressure of the gas lift valve, which would also compromise the test if the gas lift valve opens during the annular pressure test.

Accordingly, as depicted in FIG. 1B, most operators install a retrievable "dummy" valve 204 in the side pocket mandrel 200 before conducting the annulus pressure test. The dummy valve does not open and blocks the flow of pressurized test gas into the side pocket mandrel 200. Although generally effective, the dummy valve 204 must be removed and replaced with a conventional unloading or operating gas lift valve, which can be expensive and time consuming. There is, therefore, a need for an improved side pocket mandrel that prevents the passage of pressurized gas into the side pocket mandrel until the well is ready for production and utilization of the gas lift valve. The present embodiments are directed to these and other deficiencies in the prior art.

SUMMARY OF THE INVENTION

In one aspect, embodiments of the present disclosure are directed to a side pocket mandrel for use in a gas lift system configured to improve the recovery of petroleum fluids from a well, where the gas lift system is surrounded by an annular space within the well. The side pocket mandrel includes a central bore extending through the side pocket mandrel, a side pocket tube laterally offset from the central bore, a port that extends from the side pocket tube to the annular space, and a single actuation valve installed on the port. The single actuation valve prevents the passage of the petroleum fluids from the annular space into the side pocket tube until an annulus pressure exceeds a high pressure threshold and then recedes below a low threshold pressure.

In another aspect, the present disclosure is directed to a side pocket mandrel for use in a gas lift system configured to improve the recovery of petroleum fluids from a well, where the gas lift system is surrounded by an annular space within the well. The side pocket mandrel includes a central bore extending through the side pocket mandrel, a side pocket tube laterally offset from the central bore, a port that extends from the side pocket tube to the annular space, and a single actuation valve installed on the port. The single actuation valve includes a valve body, an inner channel in the valve body, an outer channel in the valve body, a plunger that partially extends into the inner channel with the single actuation valve is in a closed state, and a biasing element that urges the plunger outward to dislocate the plunger from the inner channel.

In yet another aspect, the present disclosure is directed to a side pocket mandrel for use in a gas lift system configured to improve the recovery of petroleum fluids from a well, where the gas lift system is surrounded by an annular space within the well. The side pocket mandrel has a central bore extending through the side pocket mandrel, a side pocket tube laterally offset from the central bore, a port that extends from the side pocket tube to the annular space, and a single actuation valve installed on the port. The single actuation valve includes a valve body, an inner channel in the valve body, an outer channel in the valve body, a plunger that partially extends into the inner channel with the single actuation valve is in a closed state, and one or more holding mechanisms that control the position of the plunger with respect to the inner channel such that plunger prevents the passage of the petroleum fluids from the annular space into the side pocket tube until a high threshold pressure in the annular space is reached and then the pressure in the annular space is reduced so to a low threshold pressure.

WRITTEN DESCRIPTION

As used herein, the term "petroleum" refers broadly to all mineral hydrocarbons, such as crude oil, gas and combinations of oil and gas. The term "fluid" refers generally to both gases and liquids, and "two-phase" or "multiphase" refers to a fluid that includes a mixture of gases and liquids. "Upstream" and "downstream" can be used as positional references based on the movement of a stream of fluids from an upstream position in the wellbore to a downstream position on the surface. Although embodiments of the present invention may be disclosed in connection with a conventional well that is substantially vertically oriented, it will be appreciated that embodiments may also find utility in horizontal, deviated or unconventional wells. The term "fluids" refers to gases, liquids, and mixtures of gases and liquids.

Figure 1A:
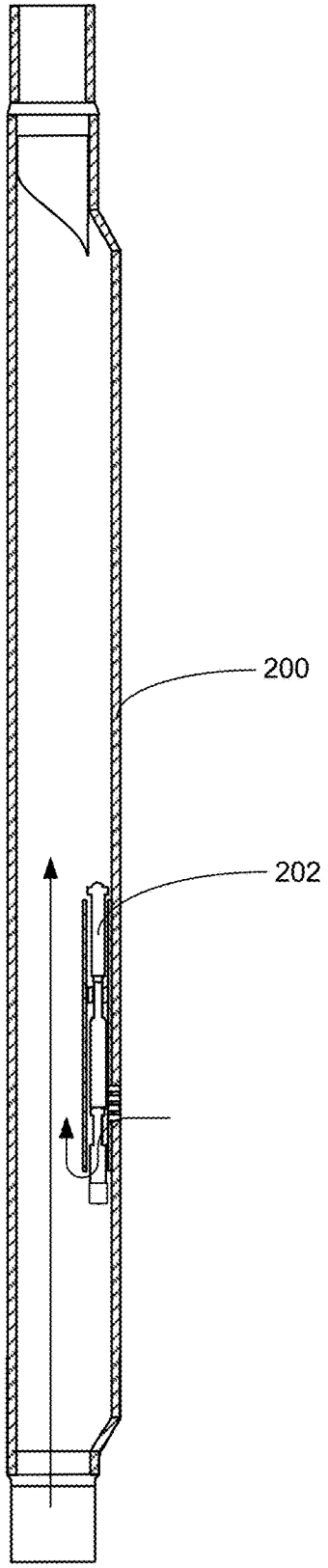
FIG. 1A PRIOR ART
FIG. 1A depicts a PRIOR ART side pocket mandrel in which a gas lift valve installed in the valve pocket is permitting the unidirectional flow of fluids from the annulus to the interior of the side pocket mandrel.
Figure 1B:
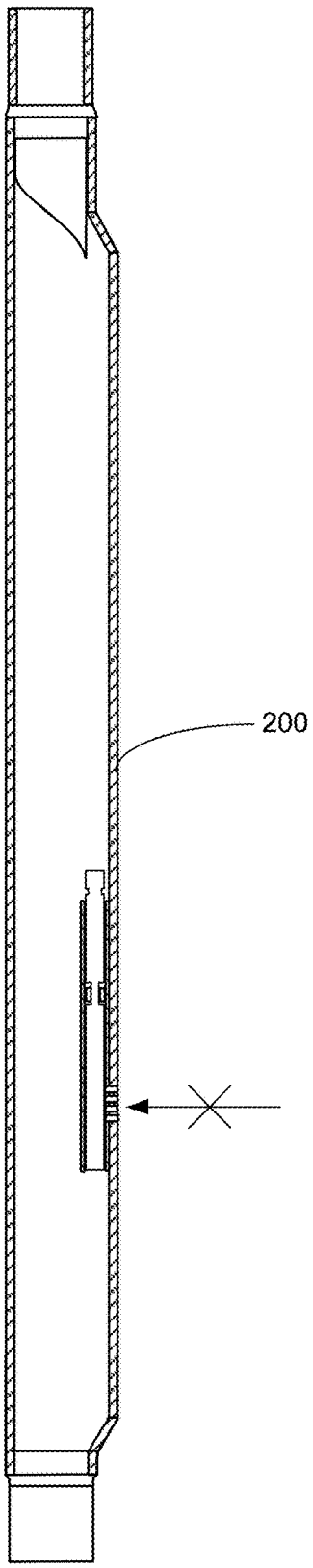
FIG. 1B PRIOR ART
FIG. 1B depicts a PRIOR ART side pocket mandrel in which fluids from the annulus are passing through the side pocket mandrel because a dummy valve is not present to prevent the passage of fluids into the side pocket mandrel during an annular pressure test.
Figure 2:
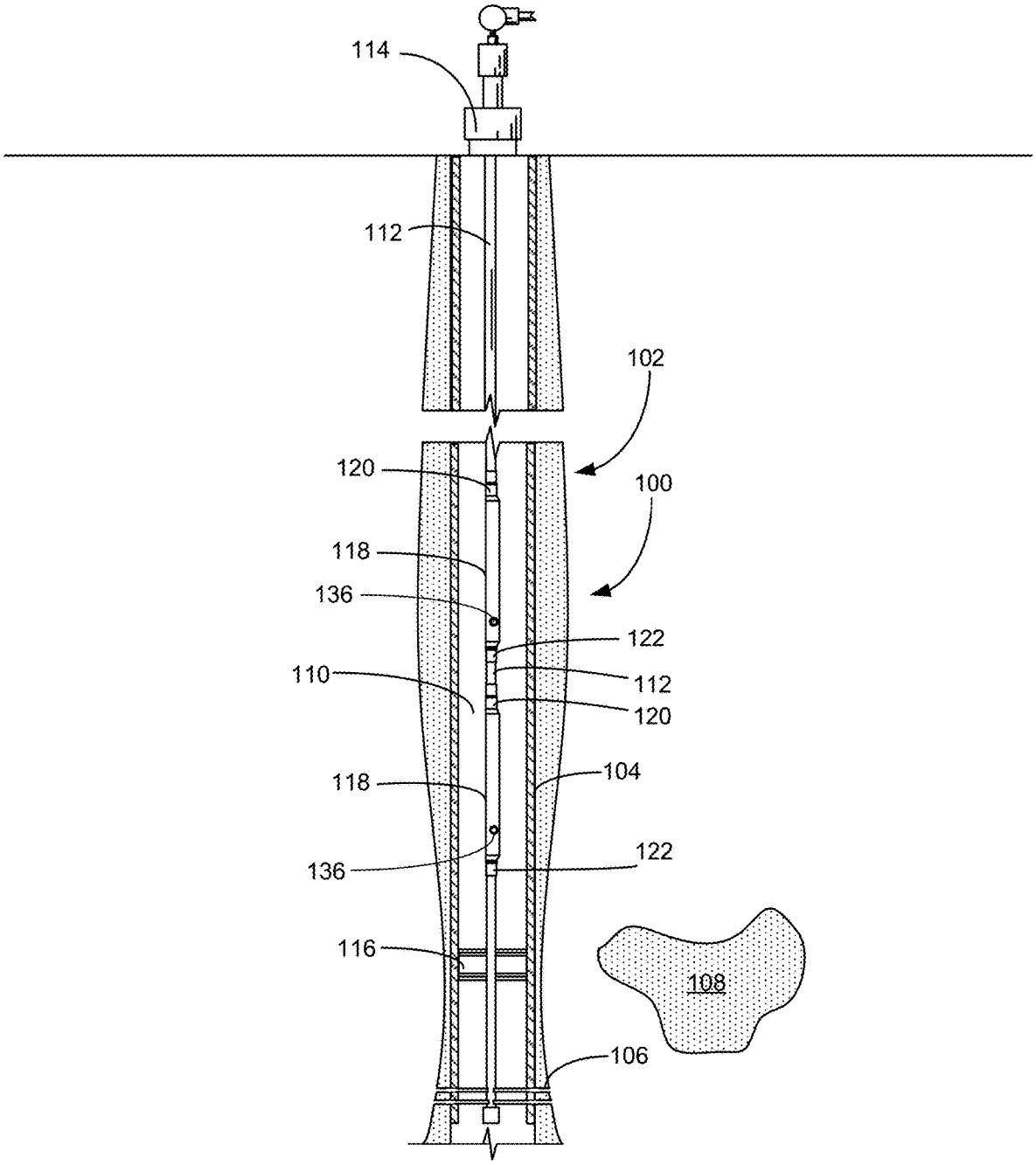
FIG. 2 is a schematic of a gas lift system constructed in accordance with an exemplary embodiment deployed in a wellbore.

Turning to FIG. 2, shown therein is a gas lift system 100 disposed in a well 102. The well 102 includes a casing 104 and a series of perforations 106 that admit wellbore fluids from a producing geologic formation 108 through the casing 104 into the well 102. An annular space 110 is formed between the gas lift system 100 and the casing 104. The gas lift system 100 is connected to production tubing 112 that conveys produced wellbore fluids from the formation 108, through the gas lift system 100, to a wellhead 114 on the surface. In the embodiment depicted in FIG. 1, the production tubing 112 extends through a packer 116 or other zone isolation device to an area of the well 102 near the perforations 106. In other embodiments, a cement completion is used to fill an uncased portion of the well 102 and the perforations 106 are formed through the cement completion. The gas lift system 100 also includes one or more side pocket mandrels 118 connected in line with the production tubing 112 above the packer 116.

Figure 3:
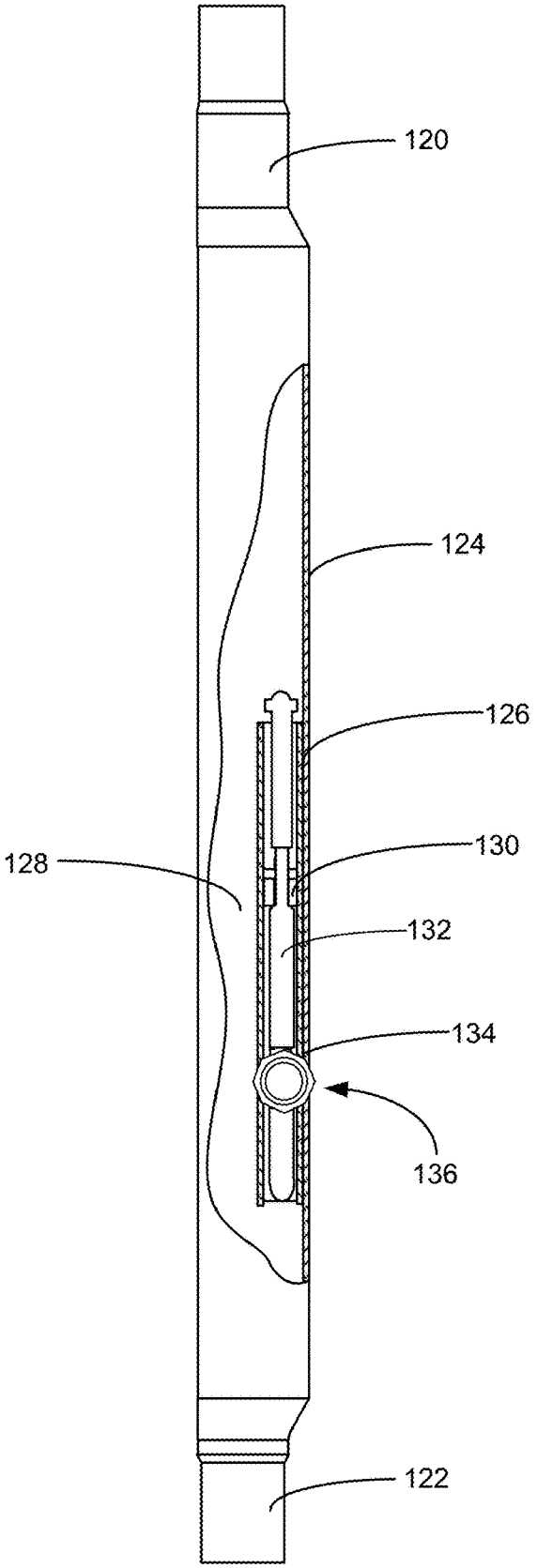
FIG. 3 is a side, partial cut-away view of a side pocket mandrel of the gas lift system of FIG. 2 with a single actuation valve installed into the annulus port.
Figure 4:
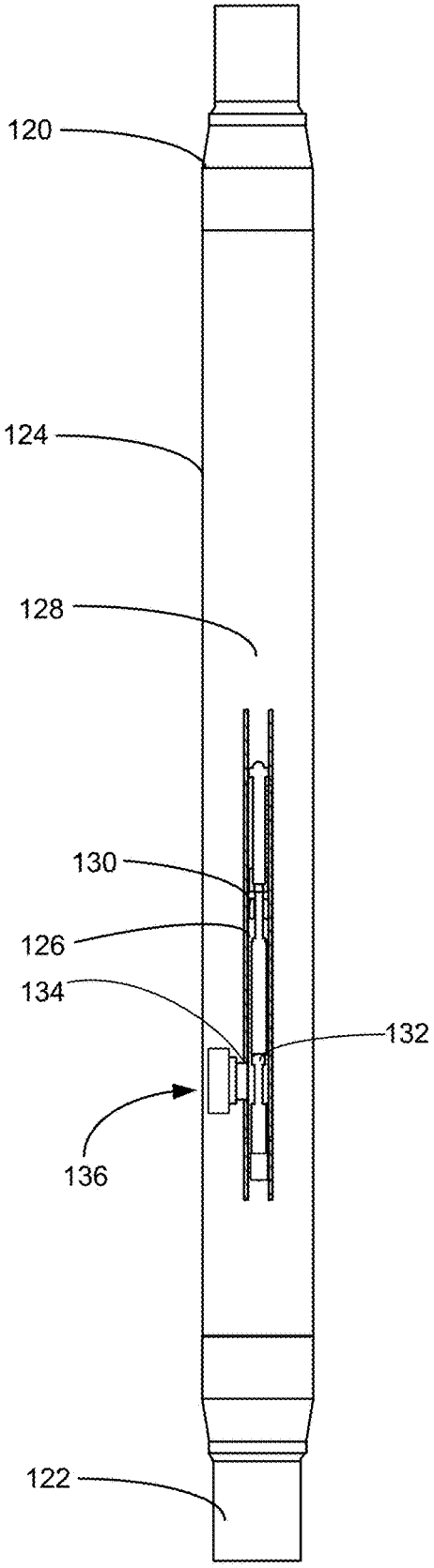
FIG. 4 is a top, partial cross-sectional view of the side pocket mandrel of FIG. 3 illustrating the connection of the single actuation valve connected to the annulus port.

Turing to FIGS. 3 and 4, shown therein are front side (with partial cutaway) and right side cross-sectional views, respectively, of an exemplary embodiment of the side pocket mandrel 118. The side pocket mandrel 118 generally includes an upper assembly joint 120 and a lower assembly joint 122 on opposite sides of the side pocket mandrel 118. The side pocket mandrel 118 includes an enlarged central portion 124 between the upper and lower assembly joints 120, 122. The central portion 124 has a larger diameter than the upper and lower assembly joints 120, 122 to accommodate the offset location of the gas lift valves.

The side pocket mandrel 118 includes a valve pocket or side pocket tube 126 within the central portion 124. In FIG. 4, the side pocket mandrel 118 has been rotated such that a side pocket tube 126 is on top of the side pocket mandrel 118. The side pocket tube 126 is laterally offset from a central bore 128 that extends colinearly along the central longitudinal axis of the production tubing 112 and upper and lower assembly joints 120, 122. It will be appreciated that the side pocket tube 126 includes a latch mechanism 130 that is designed to releasably retain a gas lift valve 132 or other downhole tool. An annular port 134 extends through the outer wall of the central portion 124 into the side pocket tube 126 to provide a path for fluids to move between the annular space 110 and the gas lift valve 132 in the interior of the side pocket tube 126. When the pressure gradient across the gas lift valve 132 exceeds the opening pressure of the gas lift valve 132, pressured fluids pass between the annular space 110 and the central bore 128 of the side pocket mandrel 118 through the annular port 134 and the opened gas lift valve 132.

To delay the opening of the side pocket mandrel 118 and the activation of the gas lift valve 132, the side pocket mandrel 118 includes one or more single actuation valves 136, each connected to a corresponding annular port 134. The single actuation valve 136 can be threaded, welded, latched or otherwise connected to the annular port 134 of the side pocket mandrel 118. As explained below, each single actuation valve 136 is configured to switch between an initial state in which the single actuation valve 136 is closed and prevents the passage of fluid from the annular space 110 into the side pocket mandrel 118 to a final state in which the single actuation valve 136 is opened and thereby places the side pocket tube 126 and gas lift valve 132 in fluid communication with the annular space 110.

Unlike a rupture plate that fails open when exposed to a setpoint pressure, the single actuation valve 136 is configured to remain closed until the pressure in annular space 110 meets or exceeds a high threshold pressure and then decreases below a low threshold pressure that permits the single actuation valve 136 to open. In some embodiments, the single actuation valve 136 is irreversibly opened after the high and low pressure thresholds are sequentially met. The single actuation valve 136 enables the operator to conduct annulus pressure tests in which the pressure in the annular space 110 exceeds the opening pressure of the gas lift valve 132 without first installing a dummy valve in the side pocket mandrel 118 during the annular pressure test. Thus, as used herein, the term "high pressure threshold" refers to a pressure in the annular space 110 that is sufficient to place the single actuation valve 136 in an initial closed-but-activated state. The term "low pressure threshold" refers to a pressure in the annular space 110 that allows the single actuation valve 136 to switch to a final open state after the single actuation valve 136 has already been activated by pressures reaching the high pressure threshold. The pressure at the high pressure threshold is therefore necessarily greater than the pressure at the low pressure threshold.

Figure 5A:
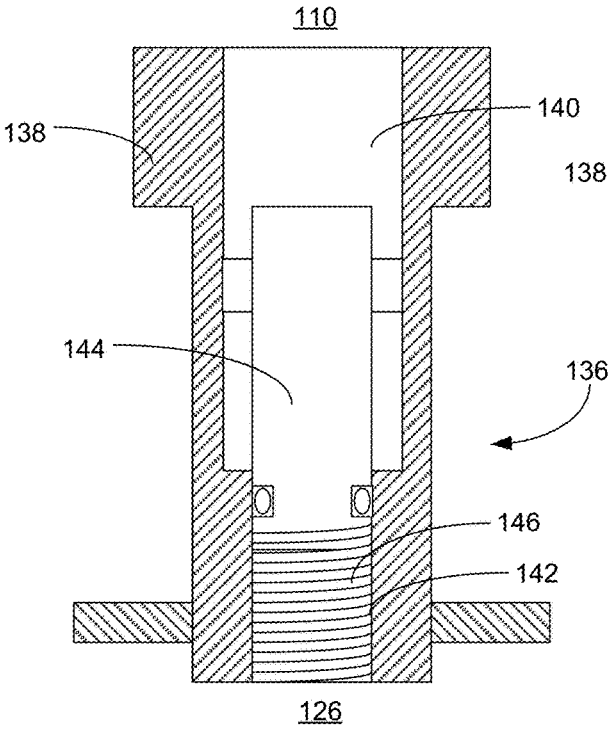
FIGS. 5A-5B present basic functional diagrams of an axial flow single actuation valve in closed and opened states.
Figure 5B:
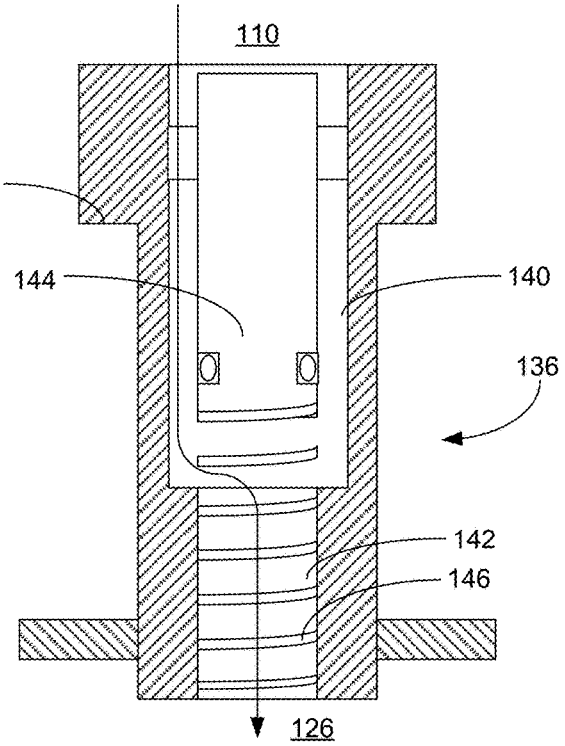

Turning to FIGS. 5A-5B, shown therein are general depictions of an axial flow embodiment of the single actuation valve 136. The single actuation valve 136 includes a valve body 138, an outer channel 140, an inner channel 142, a plunger 144, and a biasing element 146. The biasing element 146 can be a coiled spring or similar component that urges the plunger 144 out of the inner channel 142 into the outer channel 140. Initially, the plunger 144 is at least partially located in the inner channel 142, which prevents the flow of fluids from the annular space 110 and outer channel 140 from passing through the inner channel 142. When the plunger 144 is moved out of the inner channel 142, fluid from the annular space 110 is allowed to flow through the outer channel 140 and inner channel 142 into the side pocket tube 126, as depicted in FIG. 5B. In this way, the fluid passes through the single actuation valve 136 in an axial direction from the annular space 110 to the side pocket tube 126.

Figure 6A:
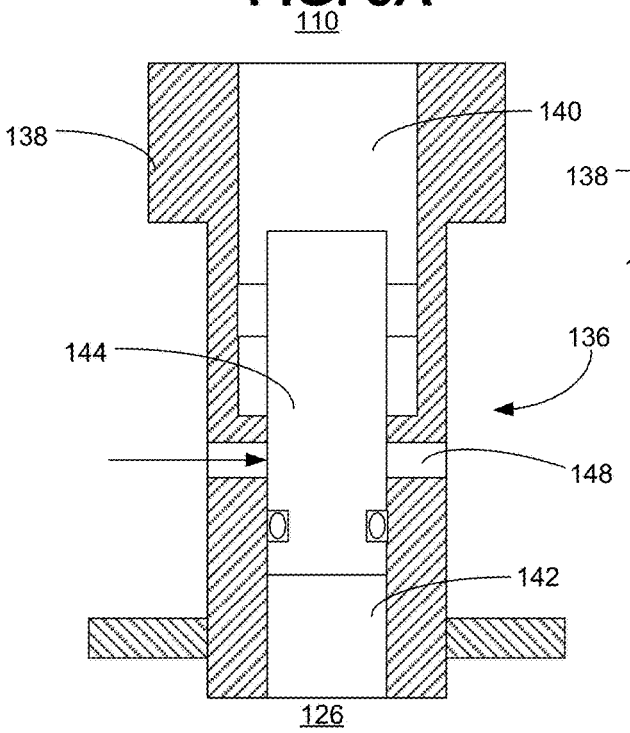
FIGS. 6A-6B present basic functional diagrams of a radial flow single actuation valve in closed and opened states.
Figure 6B:
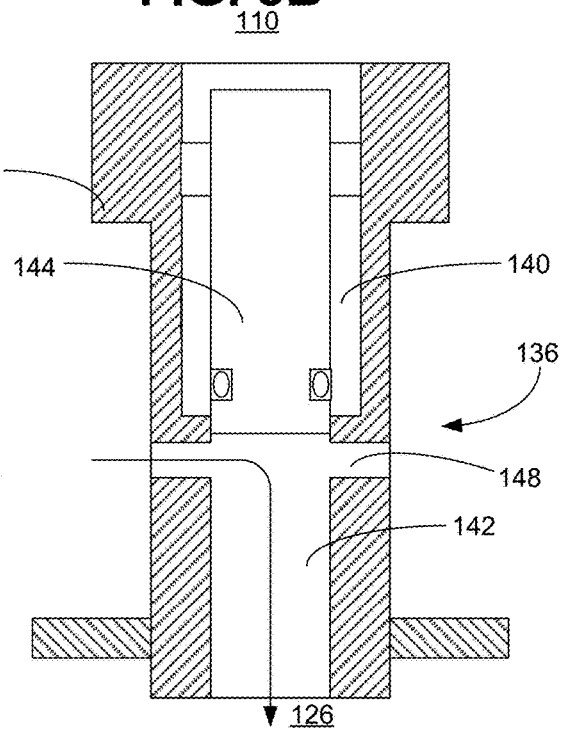

In contrast, FIGS. 6A-6B depict a radial flow embodiment of the single actuation valve 136. In this embodiment, the single actuation valve 136 also includes one or more lateral channels 148 that intersect the inner channel 142 or the outer channel 140. Initially, the plunger 144 is located in a position within the inner channel 142 that blocks the passage of fluid into the inner channel 142 from the lateral channels 148. However, when the plunger 144 is moved into a position that reveals the lateral channels 148, fluid from the annular space 110 is allowed to pass into the side pocket tube 126 through the lateral channels 148. In this way, the fluid passes through the single actuation valve 136 in a radial direction from the annular space 110 to the side pocket tube 126.

In each case, the single actuation valve 136 includes a holding mechanism that prevents the single actuation valve 136 from opening until the pressure in the annular space 110 meets or exceeds the high threshold pressure and thereafter falls below the low threshold pressure.

Figure 7A:
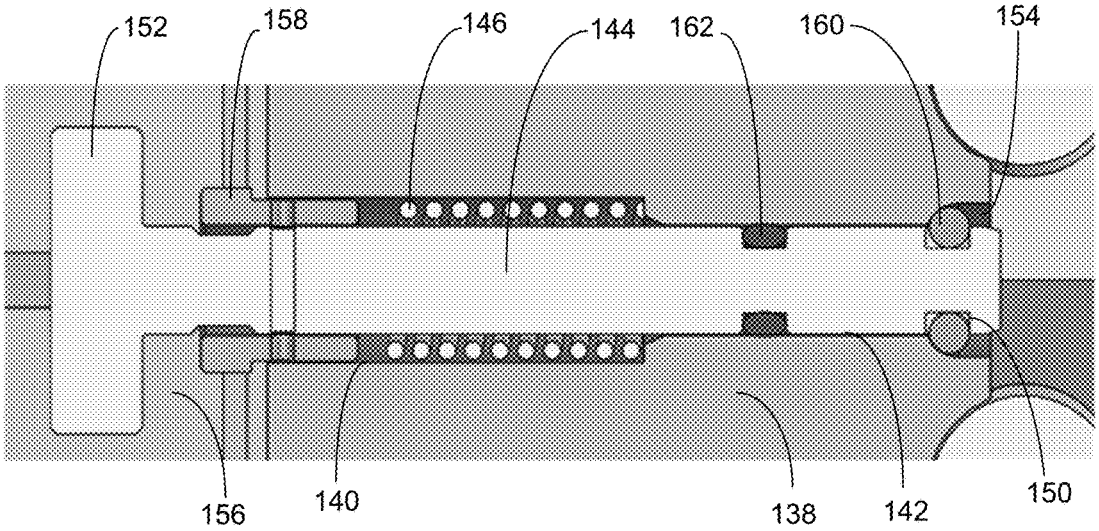
FIGS. 7A-7C present cross-sectional views an axial flow single actuation valve constructed in accordance with an exemplary embodiment.
Figure 7B:
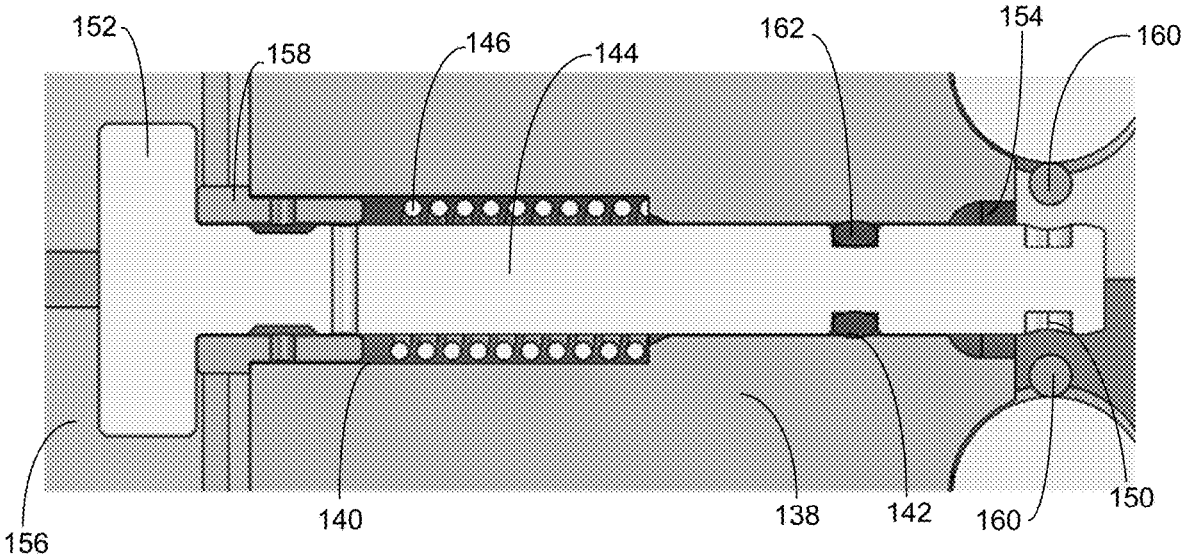
Figure 7C:
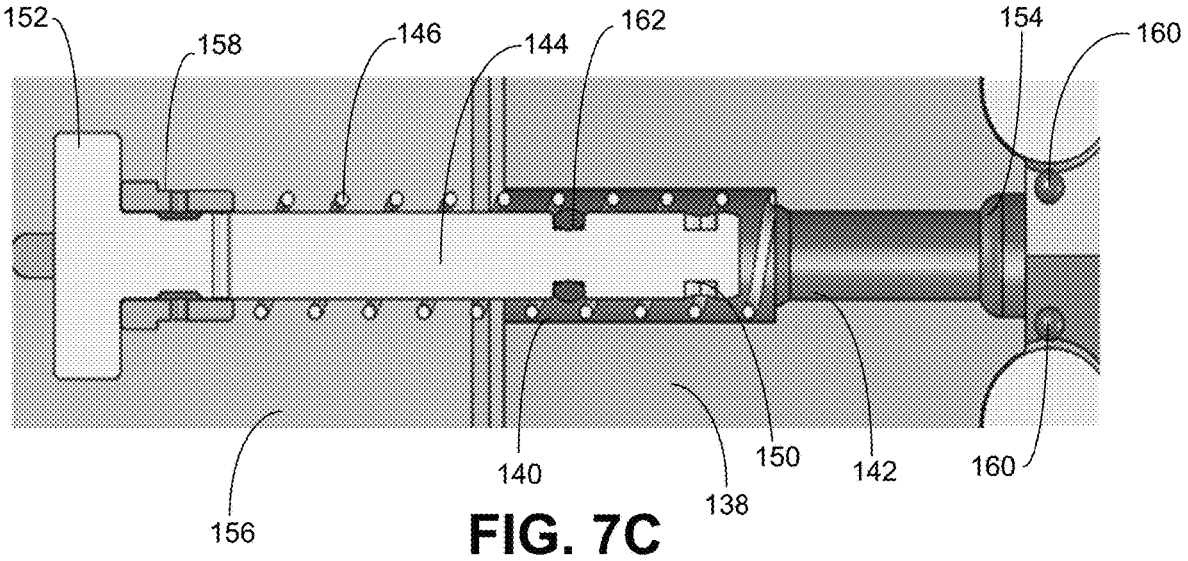

Turning to FIGS. 7A-7C, shown therein are cross-sectional depictions of a first embodiment of single actuation valve 136, which is configured as an axial flow valve. In this embodiment, the plunger 144 includes a distal groove 150 on the interior side of the single actuation valve 136 and head 152 on the exterior side of the single actuation valve 136. The valve body 138 includes a lock recess 154 adjacent to the side pocket tube 126 and an exterior chamber 156 on the opposite side of the outer channel 140 from the inner channel 142. The single actuation valve 136 further includes a collar 158 around the plunger 144 and a releasable lock 160 that is initially contained in the distal groove 150 by the lock recess 154. The releasable lock 160 can be a spring-biased element that expands away from the plunger 144 if not contained by the lock recess 154. In some embodiments, the releasable lock 160 is manufactured from a material that dissolves in the presence of water, brine or petroleum products. The plunger 144 can include one or more seals 162 that are intended to prevent the passage of fluid between the plunger 144 and the inner channel 142.

FIG. 7A depicts the single actuation valve 136 in an initial state after the single actuation valve 136 has been installed onto the side pocket mandrel 118 and the side pocket mandrel 118 is deployed into the well 102 as part of the gas lift system 100. In this state, the plunger 144 is captured in the valve body 138 by the interference fit of the releasable lock 160 between the distal groove 150 and the lock recess 154. The releasable lock 160 prevents the outward movement of the plunger 144 by the biasing element 146, which is a coiled spring in this embodiment. The head 152 is spaced apart from the collar 158 and fluid from the annular space 110 cannot pass through the single actuation valve 136 to the side pocket tube 126 because the plunger 144 and seals 162 are located inside the inner channel 142.

Once the pressure in the annular space 110 is increased, such as during an annular pressure test, the increased fluid pressure forces the plunger 144 inward until the head 152 contacts the collar 158. The collar 158 includes a shoulder that prevents the collar 158 from being pushed into the outer channel 140. The inboard movement of the plunger forces the distal groove 150 and releasable lock 160 out of the lock recess 154 in the valve body 138. The releasable lock 160 is then permitted to expand away from the distal groove 150 and separates from the plunger 144. At this point, the external pressure in the annular space 110 is greater than the outward force applied by the biasing element 146, which keeps the head 152 of the plunger 144 at the innermost position within the exterior chamber 156. During this intermediate state, fluid cannot pass through the single actuation valve 136 because the plunger 144 and seals 162 remain inside the inner channel 142. That is, the pressure in the annular space 110 meets or exceeds a high threshold pressure required to press the plunger 144 into the onboard position which frees the releasable lock 160 from the plunger 144.

When the fluid pressure in the annular space 110 decreases to an extent that the inward force of the fluid pressure acting on the head 152 is less than the outward spring force applied by the biasing element 146, i.e., the annulus pressure falls below a low threshold pressure, the plunger 144 is urged outward by the biasing element 160 as depicted in FIG. 7C. The plunger 144 is permitted to move out of the inner channel 142 because the releasable lock 160 is no longer occupying an interference position between the lock recess 154 and the distal groove 150. In this final state, fluid can pass between the annular space 110 and the side pocket tube 126 through the single actuation valve 136 because the plunger 144 and seals 162 have been pushed out of the inner channel 142. The single actuation valve 136 cannot thereafter be returned to the initial state or intermediate state without manually pushing the plunger 144 back into the inner channel 142 and reinstalling the releasable lock 160 within the distal groove 150 and lock recess 154. In this way, once the single actuation valve 136 has been deployed into the final "open" state, the single actuation valve 136 remains irreversibly open until it can be retrieved from the well 102 and serviced by a technician.

Figure 8A:
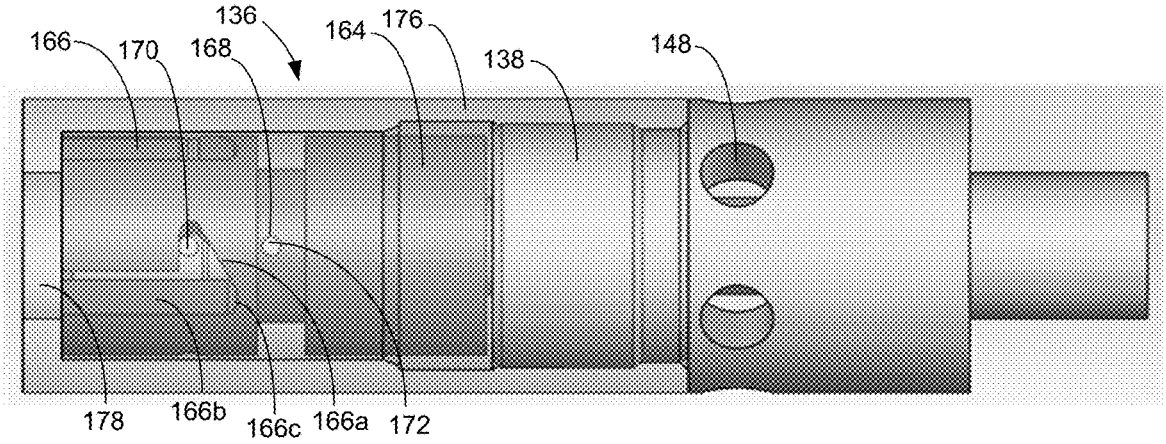
FIGS. 8A-8D present transparent and cross-sectional views of a radial flow single actuation valve constructed in accordance with a first embodiment.
Figure 8B:
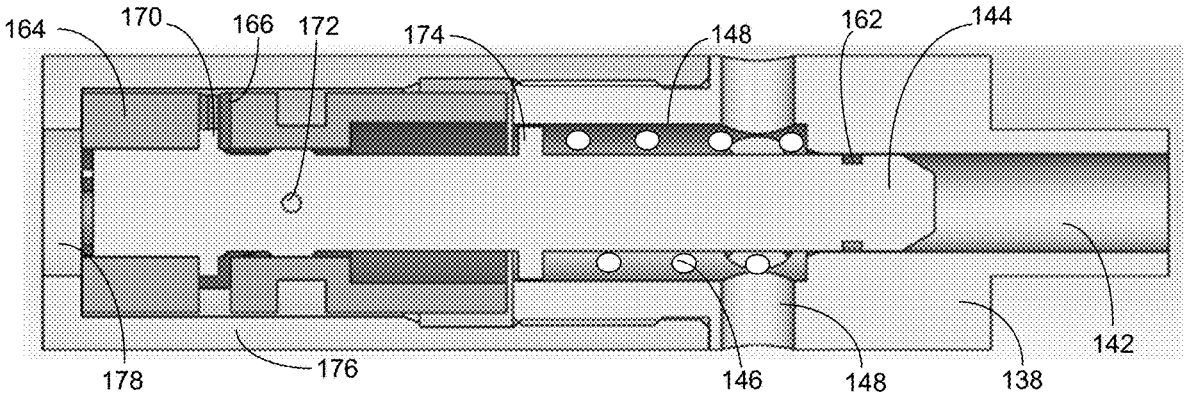
Figure 8C:
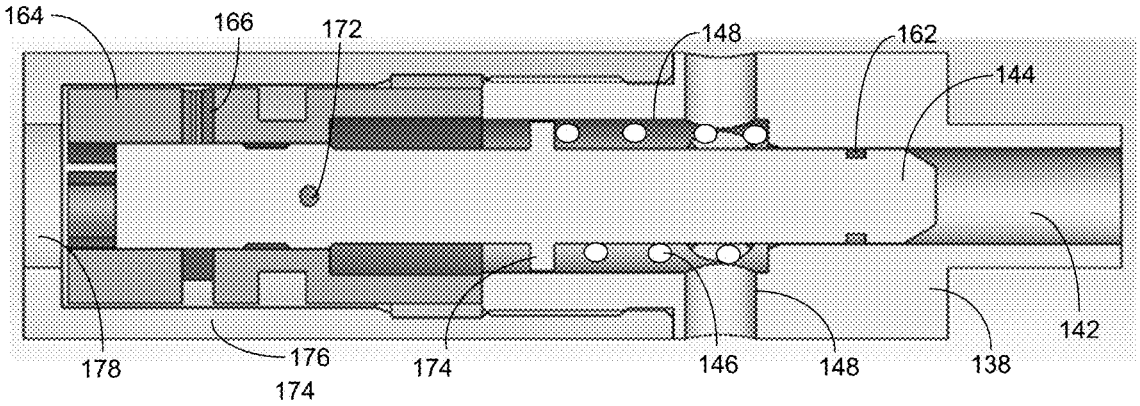
Figure 8D:
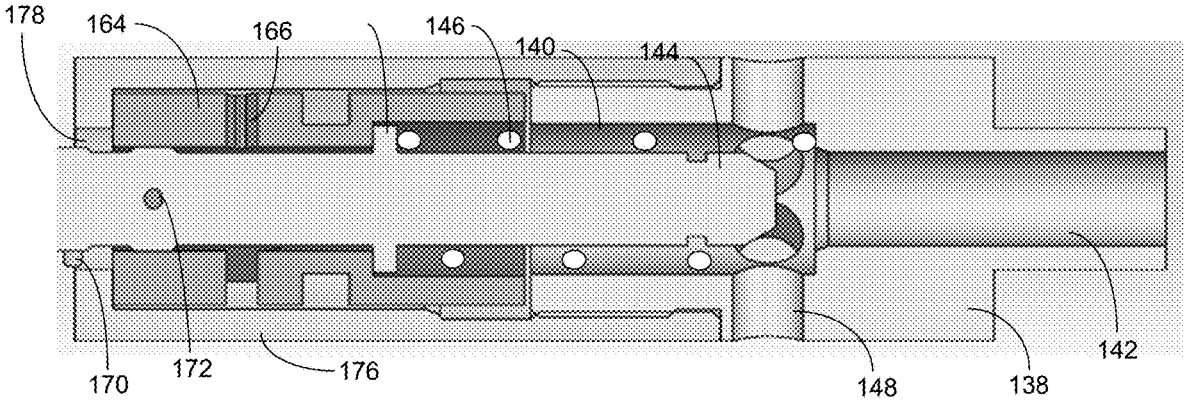

Turning to FIGS. 8A-8D, shown therein is a second embodiment of the single actuation valve 136, which is configured for radial flow. In this embodiment, the lateral channels 148 intersects the outer channel 140. Initially, as depicted in FIGS. 8B and 8C, the plunger 144 partially resides in the inner channel 142 and prevents fluid in the annular space 110 from passing into the side pocket mandrel 118 through the inner channel 142. When the plunger 144 is moved out of the inner channel 142, as depicted in FIG. 8D, fluid from the annular space 110 is permitted to pass into the side pocket tube 126 of the side pocket mandrel 118 through the unobstructed inner channel 142.

In this embodiment, the single actuation valve 136 includes a stationary guide 164 that includes one or more J-slots 166 and one or more shear pin bores 168. The stationary guide 164 can be contained within a housing 176 that includes an exterior opening 178. The housing 176 can be configured to engage the valve body 138. Each J-slot 166 has an angular branch 166*a* that intersects a straight branch 166*b* at an apex 166*c*. The plunger 144 includes one or more guide pins 170 that are captured and configured for travel within a corresponding one of the J-slots 166. The plunger 144 also includes a shear pin 172, which is initially received in the shear pin bore 168 in the stationary guide 164. The plunger 144 further includes a flange 174 that extends radially from a central portion of the plunger 144. The flange 174 has an outer diameter that is nominally smaller than the diameter if the outer channel 170. The biasing element 146 can be a coiled spring that is captured within the outer channel 140 and configured to apply an outboard force against the flange 174.

The plunger 144 is retained in its initial position by the engagement between the shear pin 172 within the shear pin bore 168, as depicted in FIG. 8A. The plunger 144 can remain in this position during the installation of the side pocket mandrel 118 in the well 102 and prior to an annular pressure test. As depicted in FIG. 8B, the single actuation valve 136 prevents the flow of fluids into the side pocket mandrel 118 in this position because the plunger 144 extends into and obstructs the inner channel 142.

When the pressure in the annular space 110 increases above a high threshold pressure during an annular pressure test or other pressure increasing event, the external force on the end of the plunger 144 forces the plunger 144 inward against the force of the biasing element 146. The inboard movement of the plunger breaks the shear pin 172, as depicted in FIG. 8C. As the plunger 144 moves inward, the guide pins 170 follow the J-slots 166, which causes the plunger 144 to rotate until the guide pins 170 land in the apex 166*c* of the corresponding J-slot 166. In this position, the plunger 144 continues to obstruct the inner channel 142, thereby preventing flow through the single actuation valve 136.

Thereafter, when the pressure in the annular space 110 is reduced below a low threshold pressure, the biasing element 146 forces the plunger 144 away from the side pocket mandrel 118 as permitted by the engagement between the guide pins 170 within the straight branches 166*b* of the J-slots 166. Once the plunger 144 has been dislocated from the inner channel 142, fluid can pass from the annular space 110 into the side pocket mandrel 118 through the lateral channels 148 and inner channel 142. The single actuation valve 136 is prevented from returning to a closed state by the configuration of the J-slot 166 and the force applied by the biasing element 146.

Figure 9A:
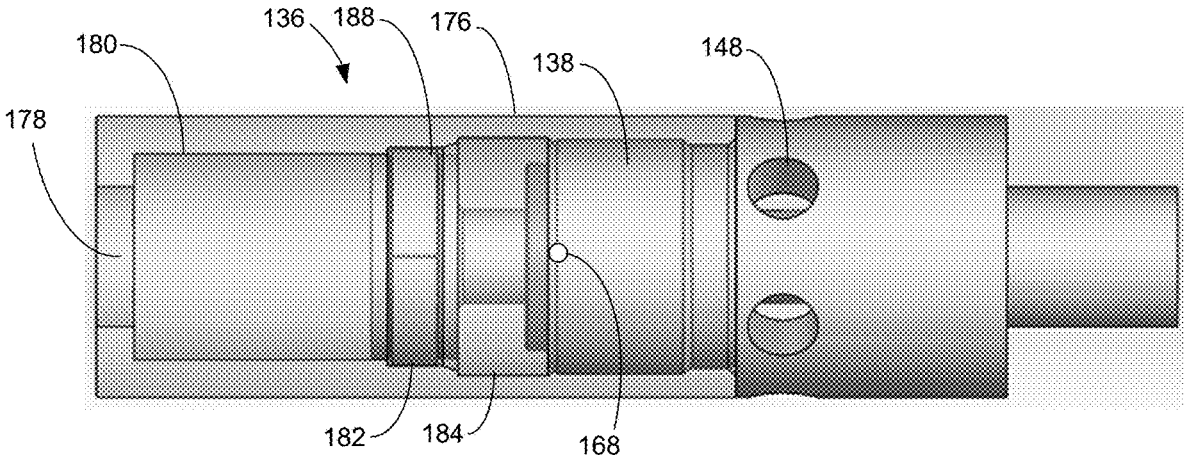
FIGS. 9A-9D present transparent and cross-sectional views of a radial flow single actuation valve constructed in accordance with a second embodiment.
Figure 9B:
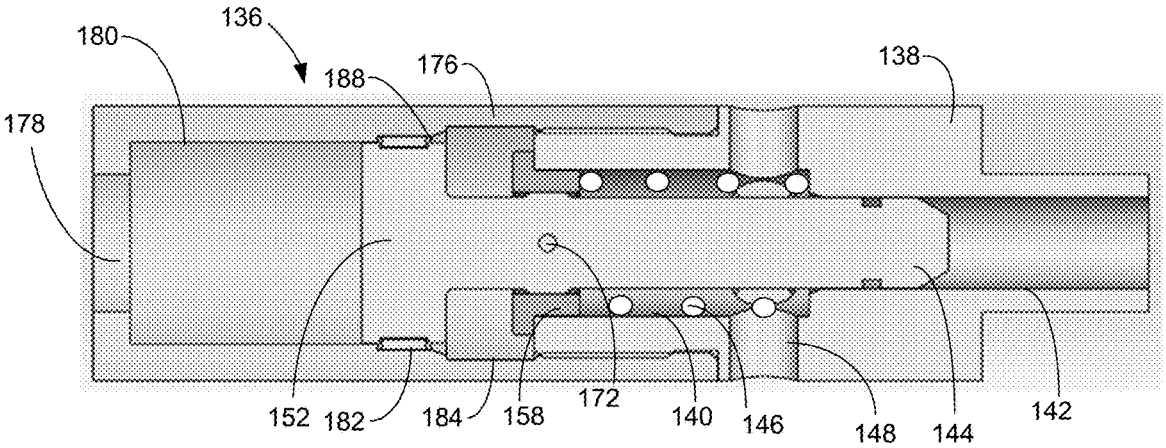
Figure 9C:
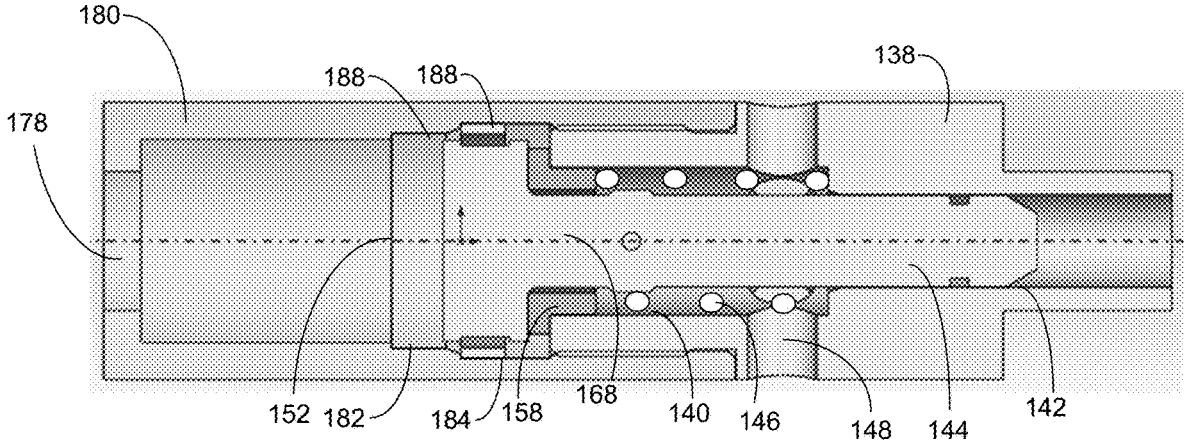
Figure 9D:
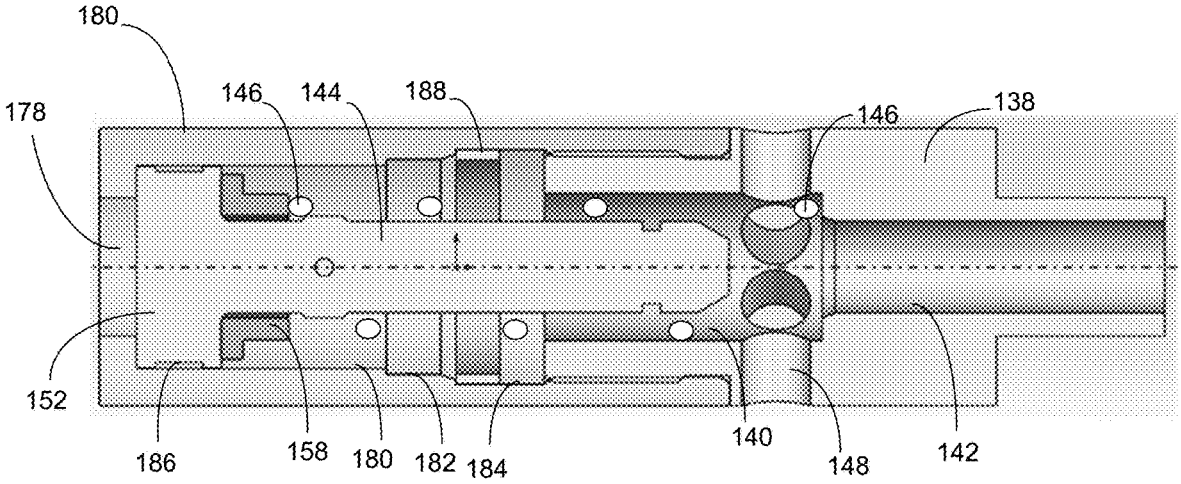

Turning to FIGS. 9A-9D, shown therein is a third embodiment of the single actuation valve 136, which is configured for radial flow. In this embodiment, the lateral channels 148 intersection the outer channel 140. Initially, as depicted in FIGS. 9B and 9C, the plunger 144 partially resides in the inner channel 142 and prevents fluid in the annular space 110 from passing into the side pocket mandrel 118 through the single actuation valve 136. When the plunger 144 is moved out of the inner channel 142, as depicted in FIG. 9D, fluid from the annular space 110 is permitted to pass into the side pocket tube 126 of the side pocket mandrel 118 through the unobstructed inner channel 142.

In the embodiment depicted in FIGS. 9A-9D, the housing 176 has an outer chamber 180 with a first diameter, an intermediate chamber 182 with a second diameter that is larger than the first diameter, and an inner chamber 184 that has a third diameter that is larger than the second diameter. The plunger 144 includes the head 152, collar 158 and shear pin 172. In this embodiment, the head 152 includes a radial recess 186 along the outer circumference of the head 152 and a compressible ring 188 is partially nested inside the radial recess 186. The compressible ring 188 can be configured as a compressible, springing C-clip with an unsprung diameter that is at least as large as the diameter of the inner chamber 184 such that it must be radially compressed when positioned in the intermediate chamber 182.

As depicted in FIG. 9B, the head 152 of the plunger 144 is initially positioned inside the intermediate chamber 180, with the compressible ring 188 in contact with the housing 176 of the single actuation valve 136. The interference fit between the releasable ring 188 and the radial recess 186 prevents the outward movement of the plunger 144. The shear pin 172 is retained within the shear pin bore 168 to prevent the plunger 144 from moving inward until a force is applied to the outside of the plunger 144 that is sufficient to break the shear pin 172. This allows the side pocket mandrel 118 to be installed in the well 102 without allowing the plunger 144 to move inward out of its initial state.

When the pressure in the annular space 110 is increased above a high threshold pressure during an annulus pressure test or other pressure increasing event, the inwardly directed force applied by the pressurized fluid on the head 152 overcomes the outwardly directed spring force applied by the biasing element 146 and the holding force applied by the shear pin 172. The shear pin 172 breaks and the plunger 144 shifts inboard until the head 152 contacts the collar 158, as depicted in FIG. 9C. The movement of the head 152 is stopped by the collar 158 and valve body 138. In this position, the compressible ring 188 is permitted to expand outward out of the radial recess 186 and into contact with the inner chamber 184. In the inboard position, the plunger 144 blocks any flow through the inner channel 142.

The plunger 144 will stay pressed against the collar 158 and valve body 138 until the pressure recedes within the annular space 110 below the low threshold pressure. Once the pressure in the annular space 110 falls below the low threshold pressure, the biasing element 146 pushes the plunger 144 outward such that the head 152 and collar 158 are retained in the outer chamber 180 and the plunger is displaced from the inner channel 142. Fluid from the annular space 110 can then pass into the side pocket mandrel 118 through the single actuation valve 136, as depicted in FIG. 9D.

Thus, in exemplary embodiments, the single actuation valve 136 provides a mechanism for delaying the opening of the side pocket mandrel 118. The single actuation valve 136 prevents the flow of fluid into the side pocket mandrel 118 until a holding mechanism is released by the sequential application of pressure in the annular space 110 that first exceeds a high threshold pressure and then recedes below a low threshold pressure, which shifts the single actuation valve 136 into an irreversible open state to permit the flow of fluid into the side pocket mandrel 118. The ability to hold the side pocket mandrel 118 in temporarily a closed state allows the operator to run an annular pressure test without installing a dummy valve in the side pocket mandrel 118 that would need to be removed and replaced with an unloading or operating gas lift valve 132 before production commences.

The holding mechanism can include one or more of the mechanisms disclosed herein, including the releasable lock 160 and lock recess 154, the shear pin 172 and shear pin bore 168, the J-slots 166 and the guide pins 170, and the compressible ring, the radial recess 186 and the intermediate chamber 182. Although the single actuation valve 136 is disclosed as being threaded or otherwise connected to the side pocket mandrel 118 as an external component, it will be appreciated that in some embodiments the single actuation valve 136 is manufactured or assembled as an integral part of the side pocket mandrel 118.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A side pocket mandrel for use in a gas lift system configured to improve the recovery of petroleum fluids from a well, where the gas lift system is surrounded by an annular space within the well, the side pocket mandrel comprising:
- a central bore extending through the side pocket mandrel;
- a side pocket tube laterally offset from the central bore;
- a port that extends from the side pocket tube to the annular space; and
- a single actuation valve installed on the port, wherein the single actuation valve prevents the passage of the petroleum fluids from the annular space into the side pocket tube until: (i) a high threshold pressure in the annular space is reached; and then (ii) the pressure in the annular space is reduced below a low threshold pressure.

2. The side pocket mandrel of claim 1, wherein the single actuation valve comprises:
- a valve body;
- an inner channel in the valve body; and
- an outer channel in the valve body.

3. The side pocket mandrel of claim 2, wherein the single actuation valve further comprises a plunger that partially extends into the inner channel with the single actuation valve is in a closed state.

4. The side pocket mandrel of claim 3, wherein the single actuation valve is configured to permit an axial flow of the petroleum fluid through the single actuation valve.

5. The side pocket mandrel of claim 4, wherein the plunger comprises:
- a head;
- a distal groove; and
- a releasable lock that prevents an outward movement of the plunger when the releasable lock is located in the distal groove of the plunger.

6. The side pocket mandrel of claim 5, wherein the valve body further comprises a lock recess and wherein the releasable lock is captured in both the distal groove and the lock recess when the single actuation valve is in an initial closed state.

7. The side pocket mandrel of claim 6, wherein the single actuation valve further comprises a biasing element that urges the plunger outward to dislocate the plunger from the inner channel.

8. The side pocket mandrel of claim 7, wherein the single actuation valve further comprises a movable collar between the head of the plunger and the valve body.

9. The side pocket mandrel of claim 3, wherein the single actuation valve is configured to permit a radial flow of the petroleum fluid through the single actuation valve.

10. The side pocket mandrel of claim 9, wherein the single actuation valve further comprises:
- a housing connected to the valve body; and
- an opening in the housing to communication the petroleum fluids from the annular space into the housing.

11. The side pocket mandrel of claim 10, wherein the single actuation valve further comprises:
- a stationary guide that includes one or more J-slots; and
- a shear pin bore.

12. The side pocket mandrel of claim 11, wherein the plunger further comprises:
- one or more guide pins that are each configured for travel within a corresponding one of the one or more J-slots; and
- a shear pin received within the shear pin bore when the single actuation valve is in a closed state.

13. The side pocket mandrel of claim 12, wherein the single actuation valve further comprises a biasing element that urges the plunger outward to dislocate the plunger from the inner channel when the shear pin has been sheared.

14. The side pocket mandrel of claim 10, wherein the housing comprises:
- an outer chamber;
- an inner chamber; and
- an intermediate chamber between the outer chamber and the inner chamber.

15. The side pocket mandrel of claim 14, wherein the plunger comprises:
- a head;
- a radial recess in an outer circumference of the head; and
- a compressible ring partially nested in the radial recess, wherein the compressible ring prevents the head from moving outboard into the outer chamber when the compressible ring is partially nested in the radial recess.

16. The side pocket mandrel of claim 15, wherein the compressible ring expands out of the radial recess in the head when the plunger moves inboard to a position in which the head is located in the inner chamber.

17. A side pocket mandrel for use in a gas lift system configured to improve the recovery of petroleum fluids from a well, where the gas lift system is surrounded by an annular space within the well, the side pocket mandrel comprising:
- a central bore extending through the side pocket mandrel;
- a side pocket tube laterally offset from the central bore;
- a port that extends from the side pocket tube to the annular space; and
- a single actuation valve installed on the port, wherein the single actuation valve comprises:
  - a valve body;
  - an inner channel in the valve body;
  - an outer channel in the valve body;
  - a plunger that partially extends into the inner channel with the single actuation valve is in a closed state;
  - a biasing element that urges the plunger outward to dislocate the plunger from the inner channel; and
  - wherein the single actuation valve prevents the passage of the petroleum fluids from the annular space into the side pocket tube until: (i) a high threshold pressure in the annular space is reached; and then (ii) the pressure in the annular space is reduced below a low threshold pressure.

18. The side pocket mandrel of claim 17, wherein the biasing element comprises a coiled spring.

19. A side pocket mandrel for use in a gas lift system configured to improve the recovery of petroleum fluids from a well, where the gas lift system is surrounded by an annular space within the well, the side pocket mandrel comprising:

a central bore extending through the side pocket mandrel;

a side pocket tube laterally offset from the central bore, wherein the side pocket tube is configured to releasably retain a gas lift valve;

a port that extends from the side pocket tube to the annular space; and a single actuation valve installed on the port, wherein the single actuation valve comprises:

a valve body;

an inner channel in the valve body;

an outer channel in the valve body;

a plunger that partially extends into the inner channel with the single actuation valve is in a closed state; and one or more holding mechanisms that control the position of the plunger with respect to the inner channel such that plunger prevents the passage of the petroleum fluids from the annular space into the side pocket tube until a high threshold pressure in the annular space is reached and then the pressure in the annular space is reduced so to a low threshold pressure.

20. The side pocket mandrel of claim 19, wherein the one or more holding mechanisms are selected from the group consisting of a combination of a releasable lock and lock recess, a shear pin and shear pin bore, a J-slot and a guide pin received in the J-slot, and a compressible ring captured in a radial recess and an intermediate chamber.

* * * * *